United States Patent [19]

Klaus

[11] 4,326,182

[45] Apr. 20, 1982

[54] C-CORE TRANSFORMER

[75] Inventor: Werner Klaus, Nauborn, Fed. Rep. of Germany

[73] Assignee: U.S. Philips Corporation, New York, N.Y.

[21] Appl. No.: 130,890

[22] Filed: Mar. 17, 1980

[30] Foreign Application Priority Data

Apr. 10, 1979 [DE] Fed. Rep. of Germany ..... 2914447

[51] Int. Cl.[3] ..... H01F 27/26; H01F 27/30

[52] U.S. Cl. ..... 336/198; 29/606; 336/210; 336/212

[58] Field of Search ..... 336/208, 198, 212, 210, 336/178; 29/606, 605

[56] References Cited

U.S. PATENT DOCUMENTS

| | | | |
|---|---|---|---|
| 1,623,143 | 4/1927 | Warren | 336/178 |
| 1,748,993 | 3/1930 | Purdy | 336/212 X |
| 2,559,803 | 7/1951 | Schneider | 336/198 X |
| 2,865,086 | 12/1958 | Whipple | 336/198 X |
| 3,264,593 | 8/1966 | Cole | 336/210 X |
| 3,344,383 | 9/1967 | Aberizk | 336/178 X |
| 3,436,574 | 4/1969 | Larsson | 336/198 X |
| 3,947,796 | 3/1976 | Postma et al. | 336/198 X |

FOREIGN PATENT DOCUMENTS

| | | | |
|---|---|---|---|
| 731536 | 2/1943 | Fed. Rep. of Germany | 336/208 |

*Primary Examiner*—Thomas J. Kozma

*Attorney, Agent, or Firm*—Thomas A. Briody; Robert T. Mayer; Bernard Franzblau

[57] ABSTRACT

A transformer comprising two C-shaped core parts arranged to form a core ring with one or more coil formers which are molded on one core leg or on both oppositely situated core legs, the core ring being interrupted between the molded coil formers.

4 Claims, 1 Drawing Figure

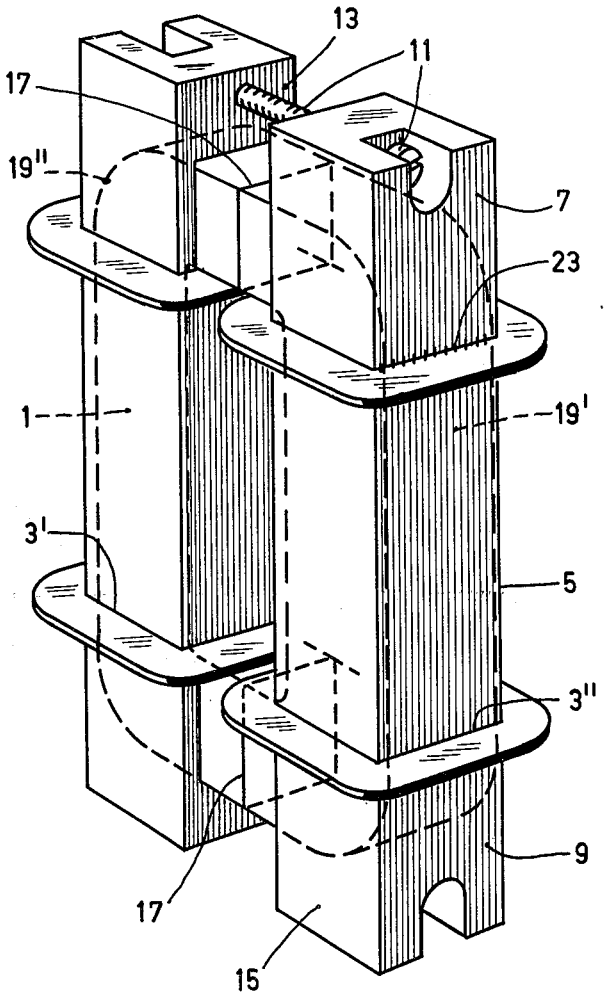
13
11
17
19''
7
23
1
19'
3'
5
3''
9
17
15

C-CORE TRANSFORMER

The invention relates to a transformer comprising a closed core which consists of two C-shaped parts and one or more coil formers accommodated on one or on two oppositely situated core legs.

C-core transformers of this kind are generally known. They are formed by sawing through a wound core at the centre of the long legs. Prefabricated coils are then slid into the leg halves thus formed. The core halves are subsequently combined again, air gaps being formed inside the coils.

This customary method of manufacturing C-core transformers has several drawbacks. For example, the coils cannot be wound on the core halves themselves. Winding is always impeded by one leg half. Furthermore, the coil formers which are slid into the leg halves are manufactured with comparatively large tolerances in order to avoid difficulties during assembly. This means that a comparatively large space remains between the iron and the coils. Moreover, sometimes the inner turn becomes detached from the iron wrap. Due to the large coil former tolerances, this inner turn then tends to vibrate freely because enough freedom of movement remains.

The invention has for its object to provide a C-core transformer in which the individual coils can be formed on the core halves and in which loose band ends are reliably fixed.

To this end, the transformer in accordance with the invention is characterized in that the coil formers are moulded around the core in such a manner that they do not enclose the locations where the core parts contact each other.

In a transformer of this kind, the coil formers moulded around the core fix the turns of the core halves during the moulding, so that vibration at a later stage, accompanied by the development of noise, is precluded. The coils can be wound on the core halves in comparatively intimate contact with the metal because the coil former encloses the iron more tightly. This results in more effective use of copper.

From German Offenlegungsschrift 25 15 836 it is known per se to mould a coil former around the central leg of a H-shaped iron core. In H-shaped iron cores of this kind, however, the drawbacks described for the known manufacture of C-core transformers are not encountered.

In a further embodiment in accordance with the invention, the coil formers comprise fixing means for the mounting of the transformer.

An embodiment in accordance with the invention will be described in detail hereinafter with reference to the accompanying diagrammatic drawing.

A closed core 1 which is wound from band iron serves as the base for a C-core transformer. This means that coil formers and coils have to be provided on oppositely situated legs of the core 1.

To this end, two coil formers 3', 3'' are adjacently moulded on the core 1 in the undivided condition. These coil formers, which may comprise one or more winding chambers, enclose the band iron material by way of their core tube 5. Any loose parts of turns have been fixed during moulding.

On both sides of their axial ends, the coil formers 3', 3'' are provided with extensions 7, 9 which project beyond the core iron and which also enclose the bends of the approximately rectangular core adjoining the legs. These extensions 7, 9 comprise continuous holes 11 wherethrough fixing bolts 13 can be inserted. Besides the continuous holes 11, the lower extensions 9 also comprise parts 15 for mounting the transformer on a chassis or printed wiring board.

After the moulding of the coil formers 3' and 3'' on the core 1, the core is cut along the lines 17 between the coil formers. Thus, two separate C-shaped core halves 19' and 19'' are formed on which the coil formers 3', 3'' are rigidly provided. The extensions 7 and 9 extend to the vicinity of the dividing line 7. The copper turns can be readily wound on the coil formers which are rigidly connected to the core halves. After the finishing of the wraps, the core halves 19' and 19'' are combined again and interconnected by means of the fixing bolts 13 which are inserted through the continuous holes 11.

The coil formers may also comprise, for example, solder connections 23 whereto the winding copper is soldered. Obviously, other fixing or connection elements can also be provided during the moulding.

What is claimed is:

1. A transformer comprising first and second separate C-shaped ferromagnetic core parts with each core part comprising a core leg including a substantially straight elongate section and first and second bends at opposite ends of the elongate section, said core parts having end faces in contact at first and second spaced locations so as to form a substantially closed core, first and said coil formers moulded around the first and second core parts, respectively, so as to be rigidly connected to the respective core legs and arranged so as not to enclose said locations where the first and second core parts contact each other, each said coil former comprising extensions which enclose the bends of the core iron adjoining the core leg and which extend into the vicinity of the dividing line between the first and second core parts and further including fixing elements for mounting the transformer.

2. A transformer comprising first and second separate C-shaped ferromagnetic core parts formed of a plurality of layers of band iron, each core part comprising a core leg including a substantially straight elongate section and two bends adjoining said elongate section, said core parts having end faces in contact at first and second spaced locations so as to form a substantially closed laminated core, a coil former moulded around each core part so as to be closely coupled to the core leg annd arranged so as not to enclose said locations where the first and second core parts contact each other, each said coil former comprising extensions which enclose the bends of the core iron adjoining the core leg and which extend into the vicinity of the dividing line between the first and second core parts.

3. A transformer as claimed in claims 1 or 2 wherein the first and second coil formers include aligned holes arranged to receive a fastening element for securing the first and second core parts together.

4. A transformer as claimed in claims 1 or 2 wherein each coil former extension includes portions at either end extending beyond the ends of the straight core leg and said bends.

* * * * *